US006561098B2

(12) United States Patent
Mayer et al.

(10) Patent No.: US 6,561,098 B2
(45) Date of Patent: May 13, 2003

(54) METHOD OF CONTROLLING THE QUANTITY OF INK IN A PRINTING MACHINE

(75) Inventors: Martin Mayer, Ladenburg (DE); Nikolaus Pfeiffer, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 229 days.

(21) Appl. No.: 09/732,151

(22) Filed: Dec. 7, 2000

(65) Prior Publication Data

US 2001/0045172 A1 Nov. 29, 2001

(30) Foreign Application Priority Data

Dec. 7, 1999 (DE) ..... 199 58 760

(51) Int. Cl.[7] ..... B41F 1/46
(52) U.S. Cl. ..... 101/483; 101/365
(58) Field of Search ..... 101/483, 211, 101/365, 366, 367, 181, 348

(56) References Cited

U.S. PATENT DOCUMENTS 4,573,410 A * 3/1986 Blasius et al. ..... 101/365
4,827,280 A * 5/1989 Stamer et al. ..... 347/6
4,852,485 A * 8/1989 Brunner ..... 101/365
5,682,573 A * 10/1997 Ishikawa et al. ..... 399/46
5,734,407 A * 3/1998 Yamada et al. ..... 347/133

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

A method of controlling a quantity of ink in an inking unit of a printing machine, includes producing an increase and a decrease, respectively, of the ink quantity from a first value to a second value by releasing, during a transition time period, a flow of ink quantity lying, respectively, above and below a second nominal value of the flow of ink quantity, corresponding to the second value. It further includes setting the ink quantity to a third value during the transition time period from the first to the second value of the ink quantity, interpolating an imaginary ink quantity between the first and the second ink quantity, beginning a new transition time period, and defining the flow of ink during the new transition time period, using a given rule as a function of the imaginary ink quantity and the third ink quantity.

4 Claims, 3 Drawing Sheets sheets

METHOD OF CONTROLLING THE QUANTITY OF INK IN A PRINTING MACHINE

BACKGROUND OF THE INVENTION

Field of the Invention

The invention relates to a method of controlling the quantity of ink located in an inking unit of a printing machine during the processing of a print job. The greater this ink quantity, the more intensive is the inking of the ink-accepting areas of a printing plate; the smaller the ink quantity, the less intense is the inking. It is therefore important to keep this quantity of ink constant, as long as the printing result is satisfactory in terms of inking and, if deviations in terms of inking are established, to be able to set the quantity of ink as quickly as possible to a new value, due to which it is expected that a printed result which is satisfactory in terms of inking will be delivered.

The inking unit of a printing machine is usually supplied with ink from an ink source, for example, in the form of an ink fountain with a metering device. It includes a more-or-less large number of inking rollers, which feed the flow of ink metered by the ink source to the printing plate. In order to set the quantity of ink in the inking unit or on an inking roller to a different value, it is necessary to vary the flow of ink released from the ink source. Because this flow of ink is distributed to a large number of rollers before it reaches the printing plate, some time elapses between the detection of a deviation in the inking and a corresponding resetting of the metering device, on the one hand, and the time at which the changed metering has any effect upon the ink supply of the printing plate, on the other hand. During this time period, rejects or waste are produced.

It is of great interest to keep the time period as short as possible. For this purpose, a method has been developed wherein an increase or reduction in the quantity of ink on the roller from a first to a second value is produced in that, during a transition time period, a flow of a quantity of ink is released which is, respectively, above and below a desired or nominal value of the ink quantity flow, corresponding to the second value, and which is defined in accordance with a given rule as a function of the first and the second quantity of ink. If the second quantity of ink is greater than the first, the flow of ink quantity in the transition time period is greater than the flow of ink quantity corresponding to the second quantity of ink; if the second quantity of ink is smaller than the first, the flow of ink quantity in the transition time period is smaller. This means that, for a period of time, an excess of ink or too little ink is fed from the ink source, in order to arrive as quickly as possible at the desired quantity of ink on the inking roller and, after the expiration of a time period, following which this second quantity of ink should approximately have been reached, a change is made to the second flow of ink quantity, which is dimensioned so that the second quantity of ink on the roller is maintained during continuous operation.

A corresponding method is also described in the published German Patent Document DE 43 37 343 A1.

SUMMARY OF THE INVENTION

It is an object of the invention to provide a method of controlling a quantity of ink in a printing machine which avoids the foregoing disadvantages of the heretofore known methods of this general type and is an improvement over the conventional methods.

With the foregoing and other objects in view, there is provided, in accordance with the invention, a method of controlling a quantity of ink in an inking unit of a printing machine, which includes maintaining a constant quantity of ink in the inking unit by releasing an appropriate, constant flow of ink quantity from an ink source, and producing an increase and a decrease, respectively, of the quantity of ink from a first value to a second value by releasing, during a transition time period, a flow of ink quantity lying, respectively, above and below a second nominal value of the flow of ink quantity, corresponding to the second value, and which is defined in accordance with a given rule as a function of the first and the second quantity of ink, which comprises setting the quantity of ink to a third value during the transition time period from the first to the second value of the quantity of ink, interpolating an imaginary quantity of ink between the first and the second quantity of ink, beginning a new transition time period, and defining the flow of ink during the new transition time period, using the given rule as a function of the imaginary quantity of ink and the third quantity of ink.

In accordance with another mode, the method includes keeping the flow of ink quantity constant during the transition time period.

In accordance with a further mode, the method includes maintaining an integral over a transition time period of a difference between the flow of ink quantity released during the transition time period and the flow of ink quantity to be released after the transition time period, proportional to the difference between the quantities of ink before and after the transition.

In accordance with a concomitant mode, the method includes interpolating the imaginary quantity of ink as follows:

$$F_f = F_1 + \frac{\int_{t_1}^{t_3} s(t) - s_2 dt}{\int_{t_1}^{t_2} s(t) - s_2 dt}(F_2 - F)_1$$

wherein $t_3$ is the time at which the third nominal value is predefined, and s(t) is the flow of ink quantity released in the transition time period.

Other features which are considered as characteristic for the invention are set forth in the appended claims.

Although the invention is illustrated and described herein as a method for controlling a quantity of ink in a printing machine, it is nevertheless not intended to be limited to the details shown, since various modifications and structural changes may be made therein without departing from the spirit of the invention and within the scope and range of equivalents of the claims.

The method of operation of the invention, however, together with additional objects and advantages thereof will be best understood from the following description of specific modes when read in connection with the accompanying drawings, wherein:

DESCRIPTION OF THE PREFERRED MODES OF THE METHOD

Figure 1:
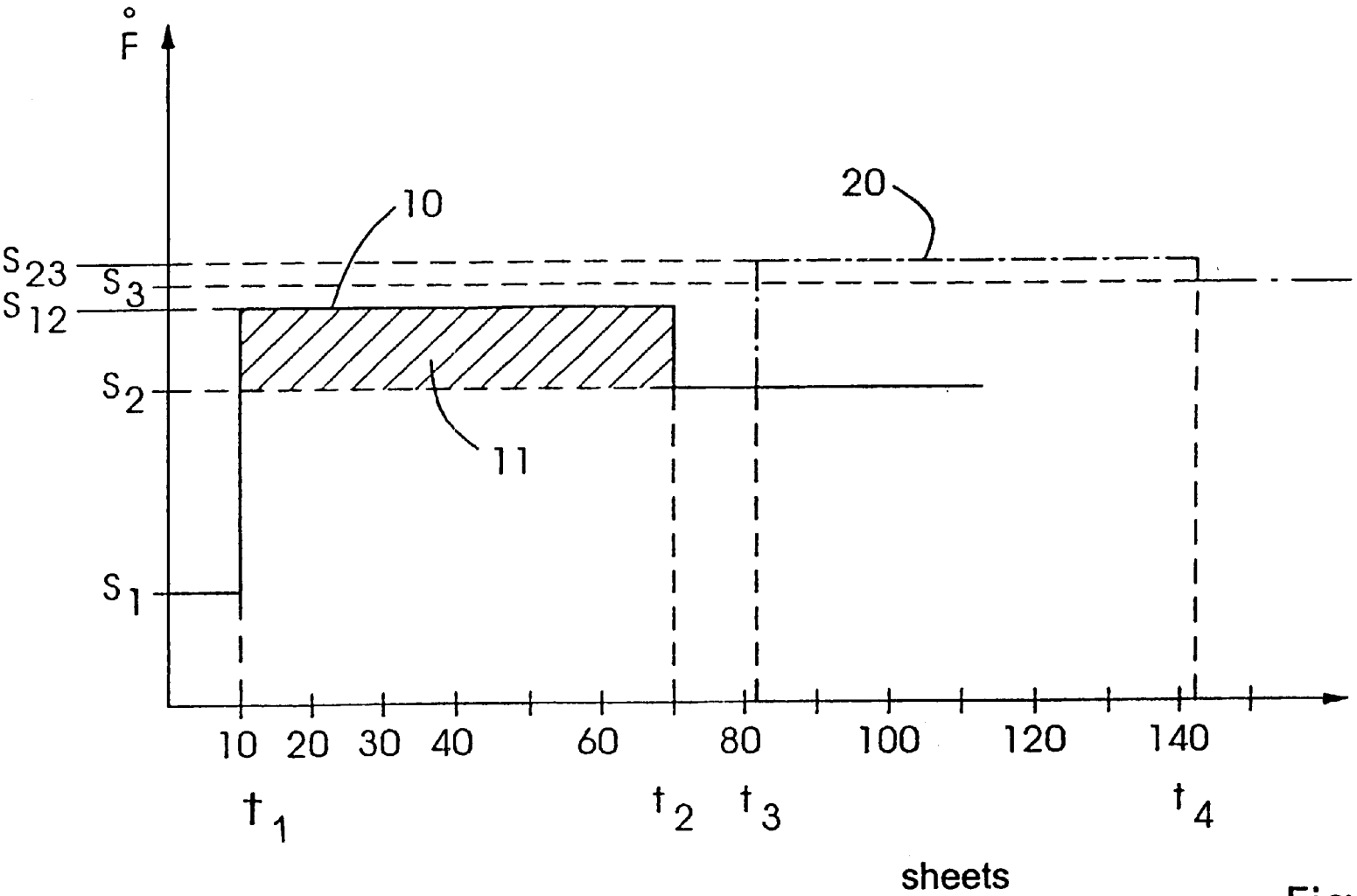
Fig.1 PRIOR ART
FIGS. 1 and 2 are plot diagrams, respectively, showing the course over time, or the time rate of change, of ink quantity flows $\dot{F}$ released by an ink source, the time, measured as the number of printed sheets, being plotted on the horizontal axis, and the ink quantity flow $\dot{F}$ being plotted on the vertical axis, in accordance with conventional methods.
Figure 2:
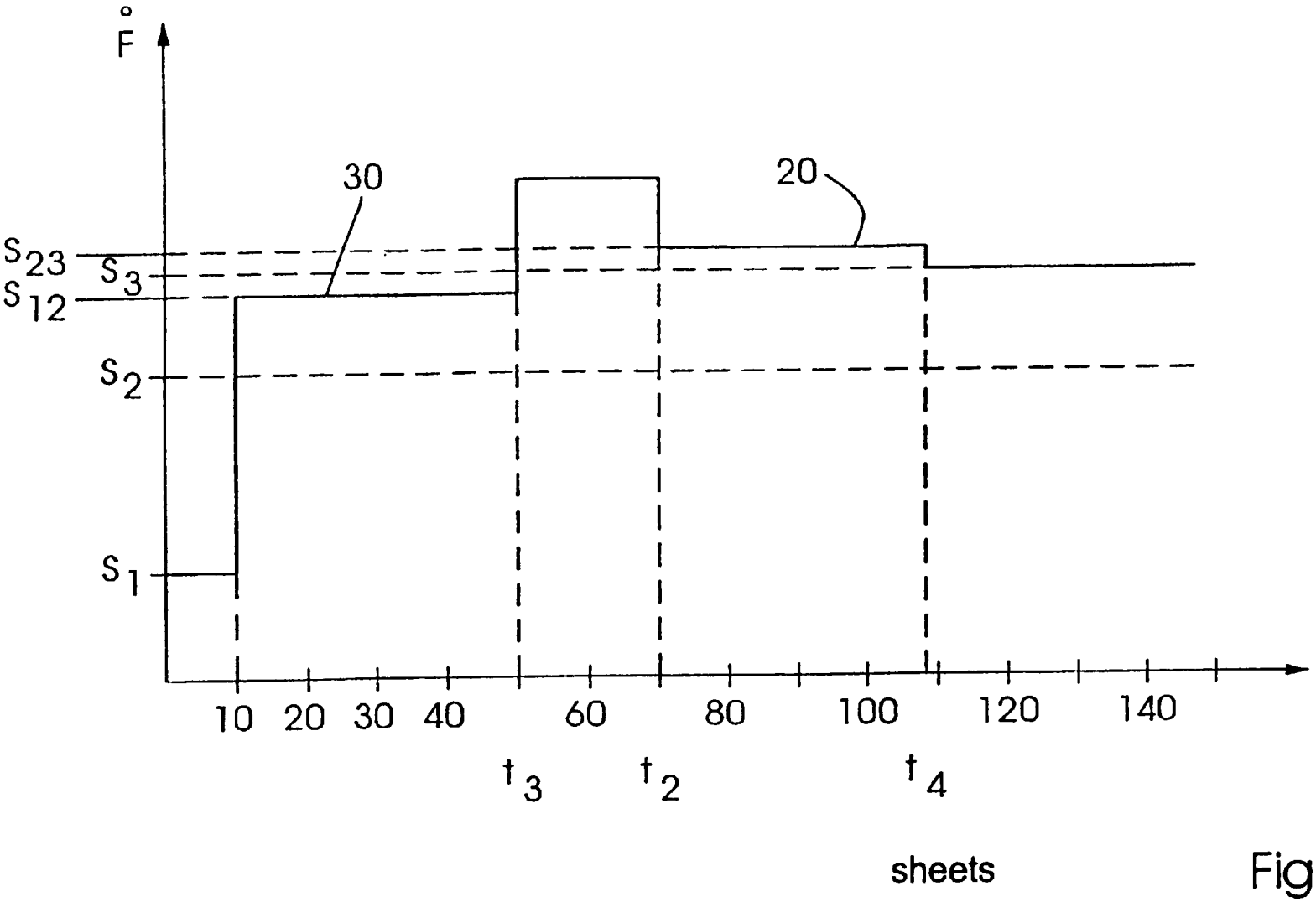
Fig.2 PRIOR ART

During the use of the conventional method, it may occur that, in the course of a transition time period, during the changeover from the first to the second quantity of ink, there is an intention to begin with a changeover to a third quantity of ink. The changeover to the third value is then implemented in accordance with the conventional method, as illustrated in FIGS. 1 and 2. As noted hereinbefore, the plot diagrams in these figures, respectively, show the course over time, or the time rate of change, of ink quantity flows $\dot{F}$ released by an ink source, the time, measured as the number of printed sheets, being plotted on the horizontal axis, and the ink quantity flow $\dot{F}$ being plotted on the vertical axis. The flow of ink quantity could be measured as the quantity of ink, i.e., the mass or volume of metered ink per unit time or per printed sheet or, in the case of an ink source which meters with the aid of a gap, the width of the gap could also be plotted as a variable proportional to this flow of ink quantity.

Referring now more particularly to FIG. 1 of the drawings, there is shown therein a curve 10 illustrating a "simple" adjusting operation, which can be performed with the aid of an electronic control circuit, for example. At the beginning of the operation, the control circuit receives a first desired value of the quantity of ink from outside. Accordingly, in the time interval from zero to $t_1$, the control circuit holds the ink source set to a first desired value $s_1$, of the flow of ink quantity. At the time $t_1$, the control circuit will predefine a new quantity of ink $F_2$ for the inking roller, for which, in order to maintain it during the current printing operation, a new and greater desired or nominal value $s_2$ of the flow of ink quantity is to be set. In order to reach the new quantity of ink $F_2$ as quickly as possible, during a transition time period $[t_1, t_2]$ of, for example, 60 sheets duration, an excessive quantity of ink is released or delivered, i.e., the width of the metering gap is overcontrolled, and the flow of ink quantity is held at a constant value $s_{12}$. After the time $t_2$, the flow of ink quantity is changed over to the second desired or nominal value $s_2$.

A broken-line or dot-dash curve 20 shows the course over time or time rate of change of the flow of ink quantity if, starting from the second desired or nominal value $s_2$, a new desired or nominal value $s_3$ is defined at the time $t_3$. The flow of ink quantity during a transition time period is also increased beyond a temporary value $s_{23}$. The durations of the transition time periods, respectively, are the same, irrespective of the desired or nominal values.

FIG. 2 shows the course over time, or the time rate of change, of the flow of ink quantity if the two changeover operations overlap in time. The course of a curve 30 is the same as for the curve 10, up to the beginning of the second changeover operation at $t_3$. At the time $t_3$, the curve rises by the same amount as the curve 20 of FIG. 1, and at the times $t_2$, $t_4$, respectively, a decrease takes place by the same amount as that at the corresponding times in the curves 10 and 20. It is therefore possible to imagine the curve 30 as an additive superimposition of the curves of two individual changeover operations. Controlling such a course of the flow of ink quantity is complicated because, after the time $t_3$, it is necessary to keep two instants of time ($t_2$ and $t_4$) stored, at which an adjustment to the flow of ink quantity, as well as the extent of the respective adjustments, must be made. A specific object of the method invention of the instant application is to simplify this control method. This object is achieved in that, when a third quantity of ink is predefined as a desired or nominal value at a time at which a changeover in the quantity of ink from the first to the second desired or nominal value has not yet been completed, an imaginary quantity of ink is interpolated between the first and the second quantities of ink, a new transition time period is begun, and the flow of ink quantity during the new transition time period is defined using the same rule, mentioned hereinabove, as a function of the imaginary quantity of ink and the third quantity of ink.

The content of the rule is preferably that the flow of ink quantity in the transition time period is constant. The duration of the transition time period is expediently independent of the quantities of ink.

Figure 3:
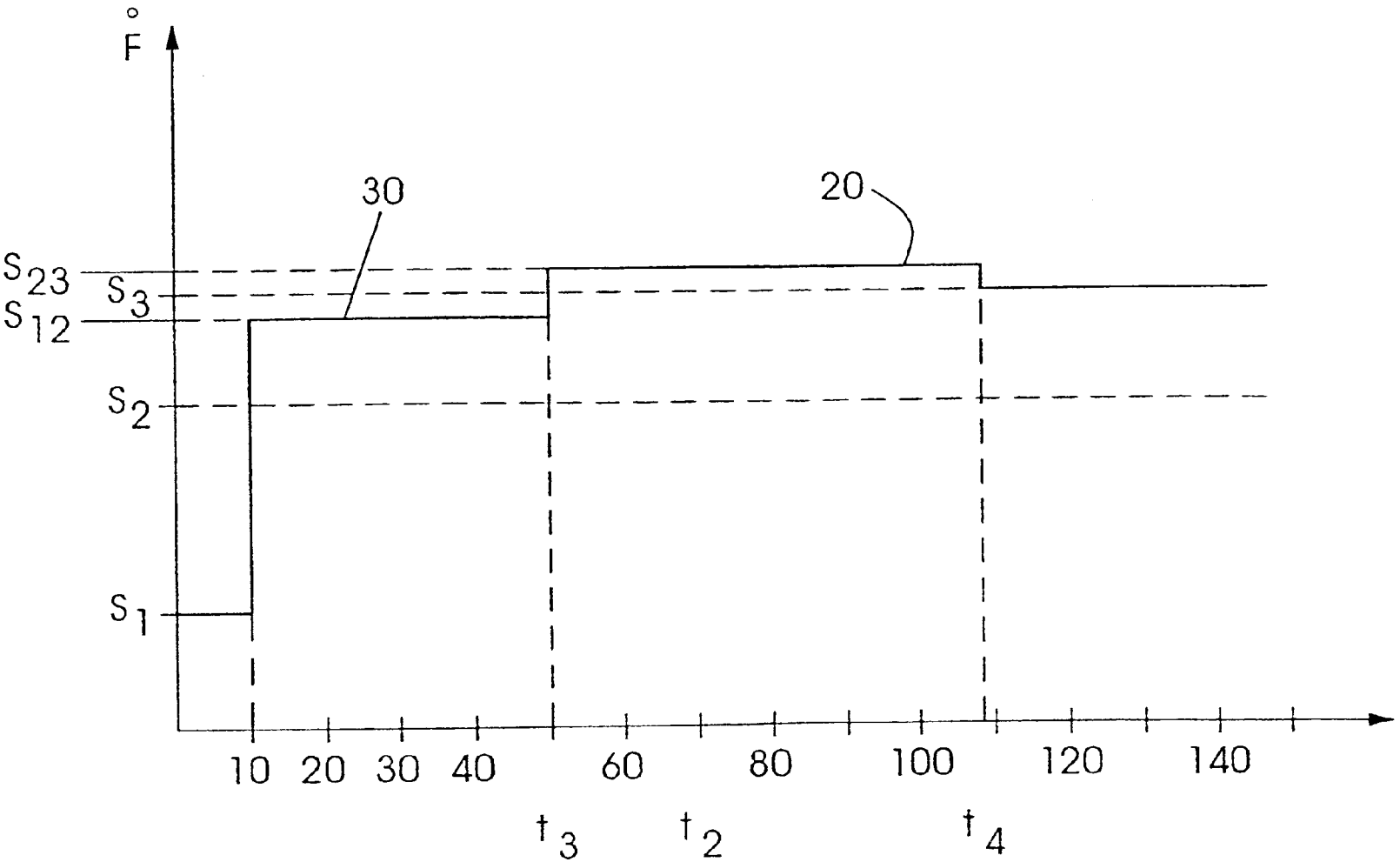
FIG. 3 is a plot diagram like those of FIGS. 1 and 2, in accordance with the method invention of the instant application.

Further features and advantages of the method invention emerge from the following description of an exemplary mode, with reference to FIG. 3.

FIG. 3, like FIG. 1, shows the course over time, or time rate of change, of a flow of ink quantity delivered by an ink source as a function of time, expressed as the number of sheets which have been printed.

In order to perform a simple changeover operation, as illustrated by the curve 10 in FIG. 1, the method according to the invention applies the following rule:

At the beginning of the changeover operation, a transition time period begins, which has a duration independent of the ink quantity flows $s_1$ and $s_2$ before and after the changeover.

The flow of ink quantity s(t) in the transition time period $[t_1, t_2]$ may be time-dependent.

In this case, the following expediently applies:

$$\int_{t_1}^{t_2} s(t) - s_2 dt \approx F_1 - F_2$$

where $F_1$ and $F_2$, respectively, are the quantities of ink in the inking unit before and after the changeover operation. In other words: s(t) is selected so that the area 11 hatched in FIG. 1 is equal to the difference $F_1-F_2$ between the quantities of ink.

A particularly simple control results if s(t) is constant in the transition time period. For example, it is possible to use the rule $$s(t)=s_2+\alpha(s_2-s_1) \text{ for } t_1<t<t_2$$

wherein $\alpha$ is a positive proportionality factor.

FIG. 3 shows the course over time, or time rate of change, of the flow of ink quantity according to the method of the invention in the case of the time superimposition of two changeover operations. At the time 0, there is in the inking unit, which has the quantity of ink to be controlled, a quantity of ink $F_1$, which, in order to be maintained, requires the flow of ink $s_1$, from the ink source. At the time $t_1$, a new desired or nominal quantity of ink $F_2$ is predefined, which, in order to be maintained, requires the flow of ink quantity $s_2$. This quantity $F_2$ on the roller would be reached if, during the entire transition time period $t_1$ to $t_2$, over which the changeover operation would normally last, the flow of ink quantity $s_{12}$ were to be maintained. In other words, in the course of the transition time period, an excess quantity of ink $(s_{12}-s_2)(t_2-t_1)$ would have to be released and delivered from the ink source. At the time $t_3$, a third desired or nominal quantity of ink is predefined for the roller. At this time, the ink source has released only the part $(s_{12}-s_2)(t_3-t_1)$ of the excess quantity of ink needed. It is therefore assumed that, at the time $t_3$, the inking unit has an imaginary quantity of ink $F_f$ which is given by $$F_f = F_1 + \frac{\int_{t_{11}}^{t_3} s(t) - s_2 dt}{\int_{t_1}^{t_{12}} s(t) - s_2 dt}(F_2 - F)_1 = F_1 + \frac{t_3 - t_1}{t_2 - t_1}(F_2 - F_1)$$

The second changeover operation is now treated in exactly the same way as though it were a simple changeover operation, which starts from the quantity of ink $F_f$ as a first desired value and is intended to reach the quantity of ink $F_3$ corresponding to the flow of ink quantity $s_3$ as a second desired or nominal value. Therefore, for the new transition time period beginning with the time $t_3$, applying the same rule as before, a uniform, constant value $s_{f3}$ of the flow of ink quantity is defined and maintained until the time $t_4$.

If a new desired or nominal value should be defined once again before the expiration of the transition time period, this can then be handled in exactly the same way again.

The method according to the invention can also and preferably be used for controlling the quantity of ink of an individual zone of an inking roller in a printing machine, which permits respective individual zones of the inking unit to have different, adjustable flows of ink applied thereto.

We claim:

1. A method of controlling a quantity of ink in an inking unit of a printing machine, which includes maintaining a constant quantity of ink in the inking unit by releasing an appropriate, constant flow of ink quantity from an ink source, and producing an increase and a decrease, respectively, of the quantity of ink from a first value to a second value by releasing, during a transition time period, a flow of ink quantity lying, respectively, above and below a second nominal value of the flow of ink quantity, corresponding to the second value, and which is defined in accordance with a given rule as a function of the first and the second quantity of ink, which comprises setting the quantity of ink to a third value during the transition time period from the first to the second value of the quantity of ink, interpolating an imaginary quantity of ink between the first and the second quantity of ink, beginning a new transition time period, and defining the flow of ink during the new transition time period, using the given rule as a function of the imaginary quantity of ink and the third quantity of ink.

2. The method according to claim 1, which includes keeping the flow of ink quantity constant during the transition time period.

3. The method according to claim 1, which includes maintaining an integral over a transition time period of a difference between the flow of ink quantity released during the transition time period and the flow of ink quantity to be released after the transition time period, proportional to the difference between the quantities of ink before and after the transition.

4. The method according to claim 1, which includes interpolating the imaginary quantity of ink as follows:

$$F_f = F_1 + \frac{\int_{t_1}^{t_3} s(t) - s_2 dt}{\int_{t_1}^{t_2} s(t) - s_2 dt}(F_2 - F)_1$$

wherein $t_3$ is the time at which the third nominal value is predefined, and s(t) is the flow of ink quantity released in the transition time period.

* * * * *